US005615875A

United States Patent [19]

Greive et al.

[11] Patent Number: 5,615,875

[45] Date of Patent: Apr. 1, 1997

[54] DEVICE FOR RECEIVING SHEET PILES THEREON IN A SHEET-FED PRINTING PRESS

[75] Inventors: Martin Greive, Heidelberg; Bernd Ruf, Weiterstadt, both of Germany

[73] Assignee: Heidelberger Druckmaschinen AG, Heidelberg, Germany

[21] Appl. No.: 421,192

[22] Filed: Apr. 13, 1995

[30] Foreign Application Priority Data

Apr. 13, 1994 [DE] Germany ..... 44 12 661.1

[51] Int. Cl.[6] ..... B65H 1/08

[52] U.S. Cl. ..... 271/147; 271/171; 271/223; 271/157

[58] Field of Search ..... 271/30.1, 145, 271/147, 171, 223, 157

[56] References Cited

U.S. PATENT DOCUMENTS

| | | | |
|---|---|---|---|
| 2,833,540 | 5/1958 | Koch . | |
| 3,198,518 | 8/1965 | Carlson et al. | 271/223 |
| 3,499,645 | 3/1970 | Noda et al. . | |
| 3,617,048 | 11/1971 | Albert | 271/171 |
| 3,861,668 | 1/1975 | Wood | 271/171 |
| 3,862,753 | 1/1975 | Giorgini | 271/171 |
| 4,940,220 | 7/1990 | Van Mechelen . | |

FOREIGN PATENT DOCUMENTS

| | | | |
|---|---|---|---|
| 0331254 | 9/1989 | European Pat. Off. . | |
| 9218195.3 | 12/1993 | Germany . | |
| 0127936 | 5/1988 | Japan | 271/171 |
| 0258323 | 10/1988 | Japan | 271/147 |
| 0532318 | 3/1993 | Japan | 271/223 |

*Primary Examiner*—H. Grant Skaggs
*Attorney, Agent, or Firm*—Herbert L. Lerner; Laurence A. Greenberg

[57] ABSTRACT

In a sheet-fed printing press, there is provided a device for receiving sheet piles thereon, including a pile table movable up and down, spacers disposed on the pile table, and pile supports of respective sizes corresponding to respective sizes or formats of the sheets disposable on the pile supports, the spacers being distributed over and locally fixed to the pile table so that the respective pile supports of varying sizes rests on a selected number of spacers sufficient for safely supporting the respective pile supports against tilting, the pile supports of respectively smaller size resting on a smaller number of the respective spacers than the pile supports of respectively larger size.

9 Claims, 5 Drawing Sheets

1
18
9
19
20
17
2
V
13
16
8
12
15
10
11
3
5
6
4
7
14

DEVICE FOR RECEIVING SHEET PILES THEREON IN A SHEET-FED PRINTING PRESS

BACKGROUND OF THE INVENTION

Field of the Invention

The invention relates to a device for receiving sheet piles thereon in a sheet-fed printing press and, more particularly, to such a device having a pile table which is movable up and down and has spacers upon which there are disposable pile supports or boards having a size corresponding substantially to a selected size or format of the sheets of a respective pile.

Devices of the foregoing general type for receiving piles thereon have become known heretofore in the prior art. Such devices serve for making-ready for the sheet-fed press paper sheets which are to be printed. When the pile table provided with the pile supports is moved upwardly as required for this purpose, the pile of sheets resting thereon is guided by a pile guide, so that the individual sheets of paper in the pile will be in a correct position. To ensure exact guidance of the sheet pile, the surface of the pile support may only be smaller than or equal in size to the surface of the sheet pile, so that it does not protrude laterally where it would be in the way. If sheets of paper of a different size or format are to be printed, then it is usually necessary to use a new pile support having an appropriate size or format.

It has become known heretofore from the prior art to mount a pile support on a pile table with an interpositioning of spacers, which have the shape of angles which are displaceably disposed on the pile table. Before a new pile support with different dimensions is used, it is necessary to shift the angles into such a position that the pile support rests securely on them. These adjusting operations are troublesome. It is thus relatively costly to change the device for receiving a pile of sheets of a particular size or format over to accommodate a pile of sheets of a different size or format.

SUMMARY OF THE INVENTION

It is accordingly an object of the invention of the instant application to provide a device for receiving a pile of sheets of a particular size or format thereon which is changeable over to accommodate a pile of sheets of a different size or format within a relatively short time.

With the foregoing and other objects in view, there is provided, in accordance with the invention, in a sheet-fed printing press, a device for receiving sheet piles thereon, comprising a pile table movable up and down, spacers disposed on the pile table, and pile supports of respective sizes corresponding to respective sizes or formats of the sheets disposable on the pile supports, the spacers being distributed over and locally fixed to the pile table so that the respective pile supports of varying sizes rests on a selected number of spacers sufficient for safely supporting the respective pile supports against tilting, the pile supports of respectively smaller size resting on a smaller number of the respective spacers than the pile supports of respectively larger size.

In accordance with another feature of the invention, the spacers have a rodlike shape and rest with a respective elongated side thereof on the pile table.

In accordance with a further feature of the invention, the spacers are formed of plastic material.

In accordance with an added feature of the invention, the spacers have protrusions on the respective elongated sides thereof facing away from the pile table, the protrusions engaging in corresponding receiving depressions formed in the pile supports upon placement of the pile supports on the spacers.

In accordance with an additional feature of the invention, the protrusions are of rodlike construction.

In accordance with yet another feature of the invention, the protrusions are formed as separate pins, which are secured in respective recesses formed in the spacers.

In accordance with yet a further feature of the invention, the pins have a circular cross section.

In accordance with yet an added feature of the invention, the receiving depressions are formed as bores.

In accordance with a concomitant feature of the invention, at least one of the rodlike spacers extends in a lengthwise direction which is transverse to the lengthwise direction of at least another of the rodlike spacers.

As a result of the foregoing construction, the spacers are in optimal positions for non-tiltingly supporting the pile supports of varying sizes and, accordingly, the time required for converting the device for receiving piles of sheets of different sizes or formats from one size or format to another is shortened considerably.

If the spacers are of rodlike construction and, respectively, rest with one elongated side thereof on the pile table and if, moreover, they are approximately quadrilateral in cross section and, more particularly, rectangular, a large supporting surface area for the pile supports is formed on the spacers, so that a relatively small number of spacers suffices to support pile supports of varying dimensions thereon in a manner which avoids tilting.

These spacers can be manufactured in a relatively simple and economical manner by injection molding, if they are formed of plastic material.

The entire device for receiving sheet piles is inclined slightly towards the rear, so that for stable, non-shifting support of the pile support on the spacers, it is advantageous if the spacers have protrusions or projections on the elongated sides thereof facing away from the pile table, the protrusions engaging in corresponding receiving depressions or indentations formed in the pile supports when the pile supports are placed on the spacers. By suitable disposition of the receiving depressions or indentations, the position of the pile support on the spacers can, moreover, be precisely defined, thereby ensuring that the pile of sheets will rest centrically on the pile support even if the sheet size or format is larger than the size of the pile support. In particular, these protrusions are of rodlike shape, and it is advantageous for the protrusions to be formed of separate pins which are secured in recesses formed in the spacers. The pins may have a circular cross section, so that they can be introduced into receiving indentations or depressions formed as bores, and particularly blind bores.

Other features which are considered as characteristic for the invention are set forth in the appended claims.

Although the invention is illustrated and described herein as embodied in a device for receiving sheet piles thereon in a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
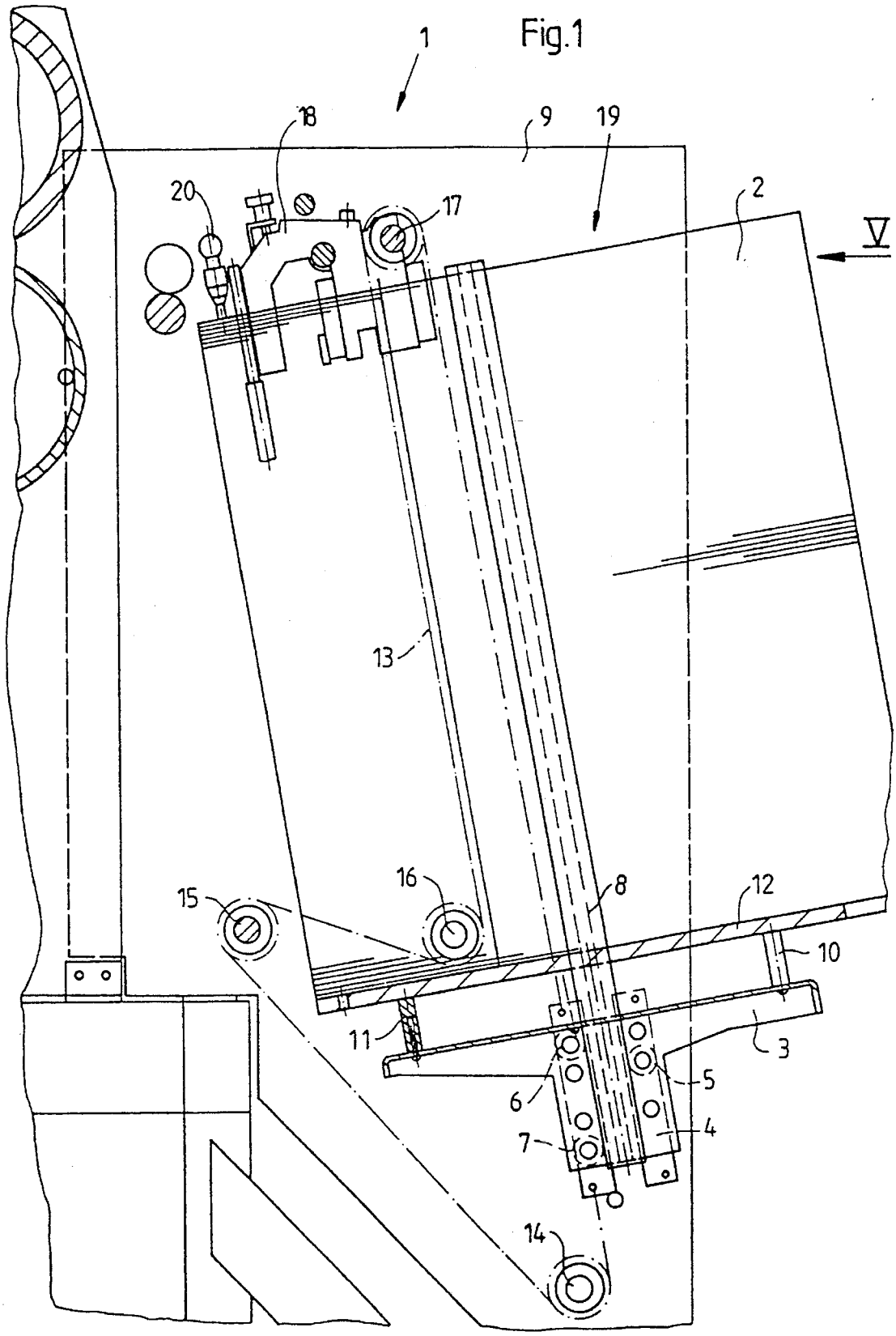
FIG. 1 is a fragmentary side elevational view of a device for receiving sheet piles thereon in a lower position thereof.

Referring now to the drawings and, first, particularly to FIG. 1 thereof, there is shown therein, somewhat diagrammatically and in a side elevational view, a device 1 for receiving piles 2 of sheets thereon. The device includes a pile table 3 to be described in further detail hereinafter having guide carriages 4 on both sides of the underside thereof. These guide carriages 4 are disposed so as to be drivable on a respective rail 8 via rollers 5, 6 and 7, the rails 8 being secured to side walls 9 located on both sides of the pile table 3. Spacers, of which two spacers 10 and 11 are shown in FIG. 1, are disposed on the pile table 3, and a pile support or board 12 on which the pile 2 of sheets is supported rests on the spacers 10, 11. The device 1 is part of a sheet-fed printing press, which need not be described in further detail herein.

A chain 13, which is guided over deflection rollers 14, 15, 16 and 17, is secured to both sides of each guide carriage 4. By means of a motorized drive not shown in FIG. 1, the deflection rollers 14 to 17 can be set into rotation, so that the guide carriage 4 can consequently be moved along the rail 8 by means of the chain 13.

Also diagrammatically illustrated in FIG. 1 are lateral guide baffles or plates 18 which serve to align or straighten the upper part of the sheet pile 2 in such a way that the topmost paper sheets 19 arrive in a correct position in the vicinity of a device which grips the uppermost sheet 19 and delivers it to a further structural unit of the printing press not shown in further detail in FIG. 1. To that end, this gripping and delivering device has a plurality of suckers of which only one sucker 20 is shown in FIG. 1.

During the printing operation, the pile table 3, with the pile support 12 disposed thereon and with the sheet pile 2 mounted on the pile support, is pulled upwardly slowly by the chain 13, the guide carriage 4 disposed on the underside of the pile table 3 moving along the rail 8 in the process. The topmost sheet 19 is gripped by the suckers 20, removed from the pile 2, and delivered to further structural units of the otherwise non-illustrated printing press.

Figure 2:
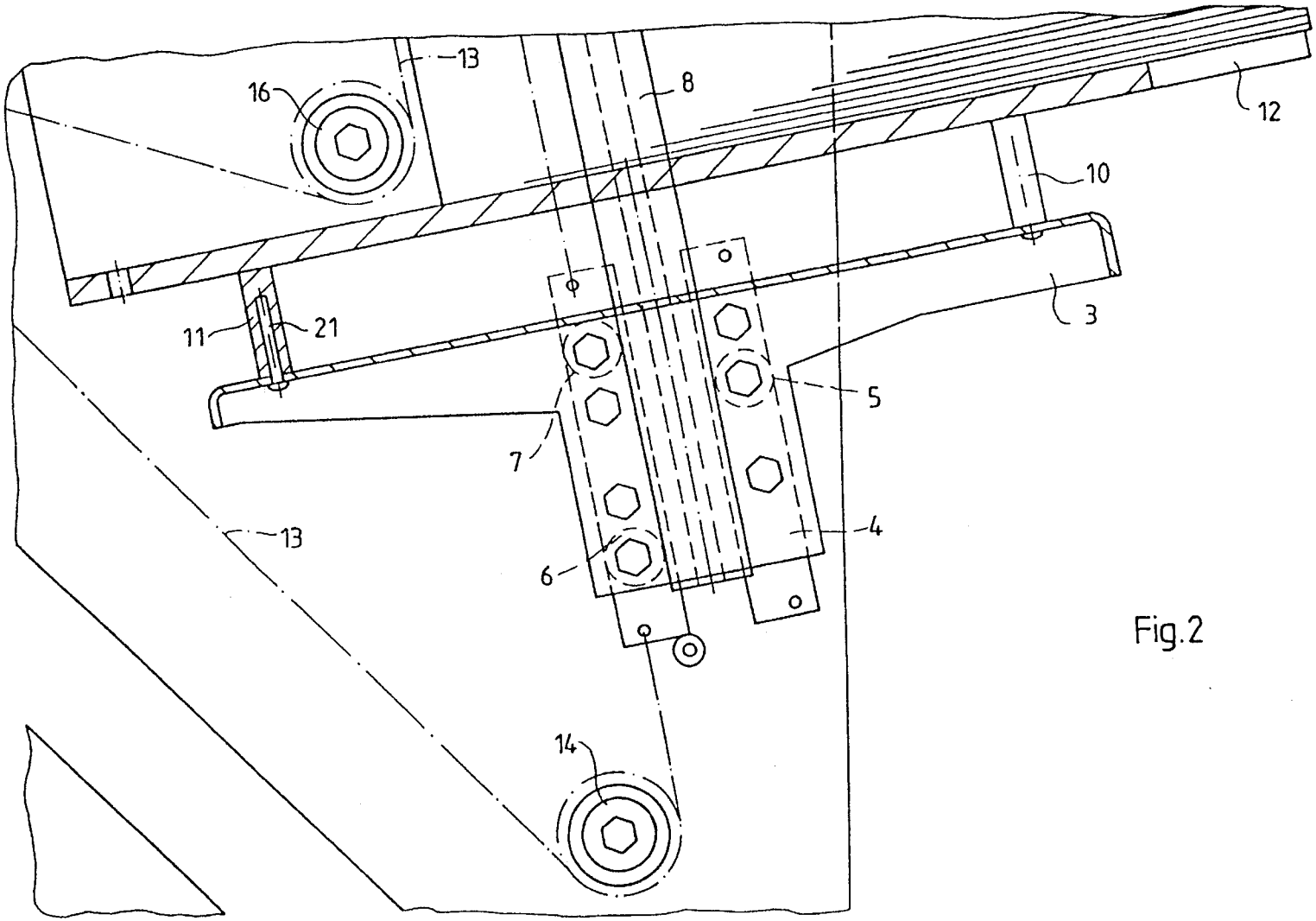
FIG. 2 is an enlarged fragmentary view of FIG. 1 showing a pile table with a pile support or board of the device in the lower position.

FIG. 2 is an enlarged view of the pile table 3 with the guide carriage 4 located in a lower position. The spacers 10 and 11, on which the pile support 12 rests, are secured to the pile table 3 by means of screws 21.

Figure 3:
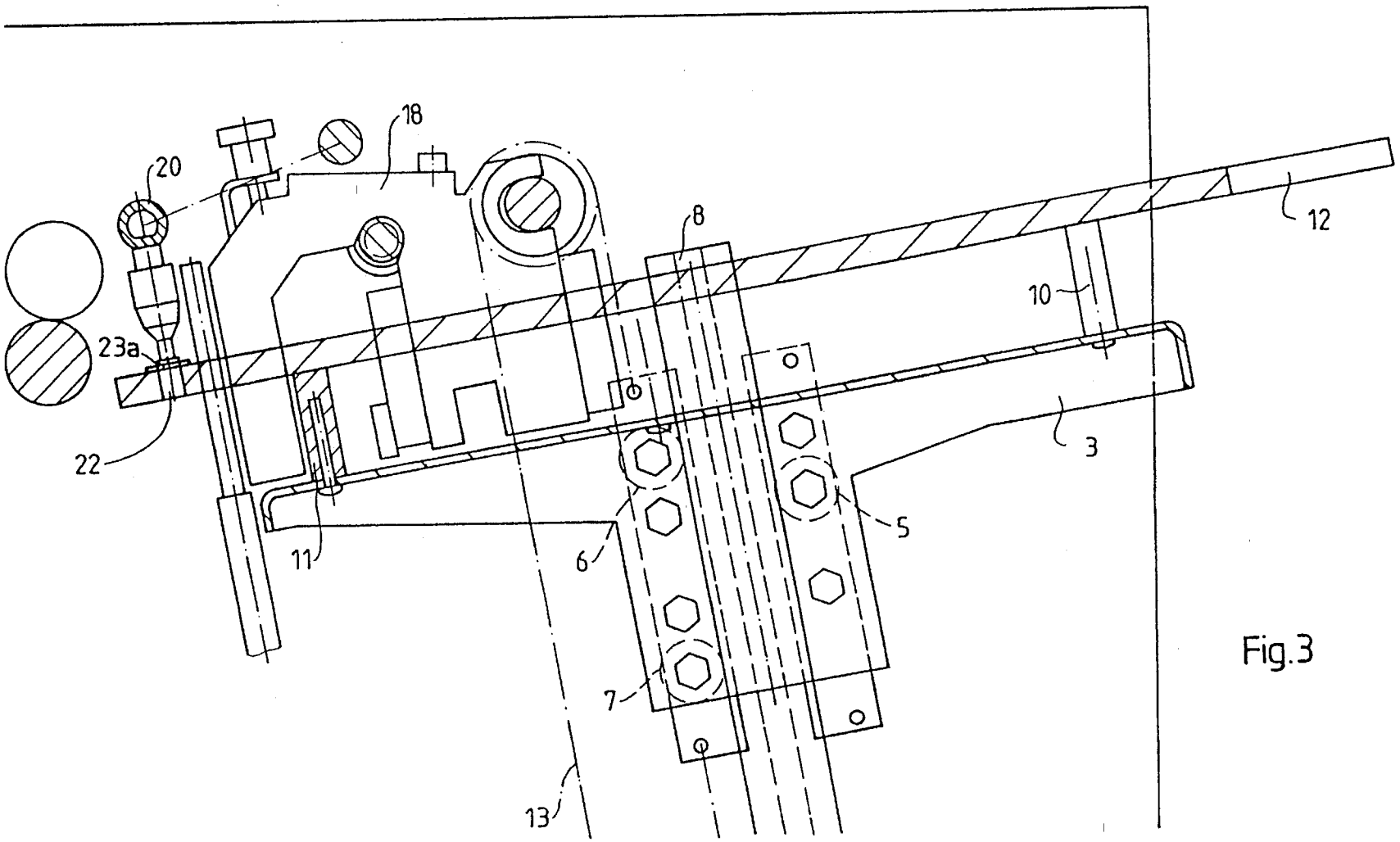
FIG. 3 is a view like that of FIG. 2, showing the pile table with the pile support in an upper position thereof.

In FIG. 3, the pile table 3 is shown in its uppermost position. To prevent the sucker 20 from ultimately sticking to the pile support 12 due to the suction, a through bore 22 is formed at a location of the pile support 12 at which the suction cup 23*a* of the sucker 20 comes into contact with the pile support 12 after the last sheet of paper has been removed.

Figure 4:
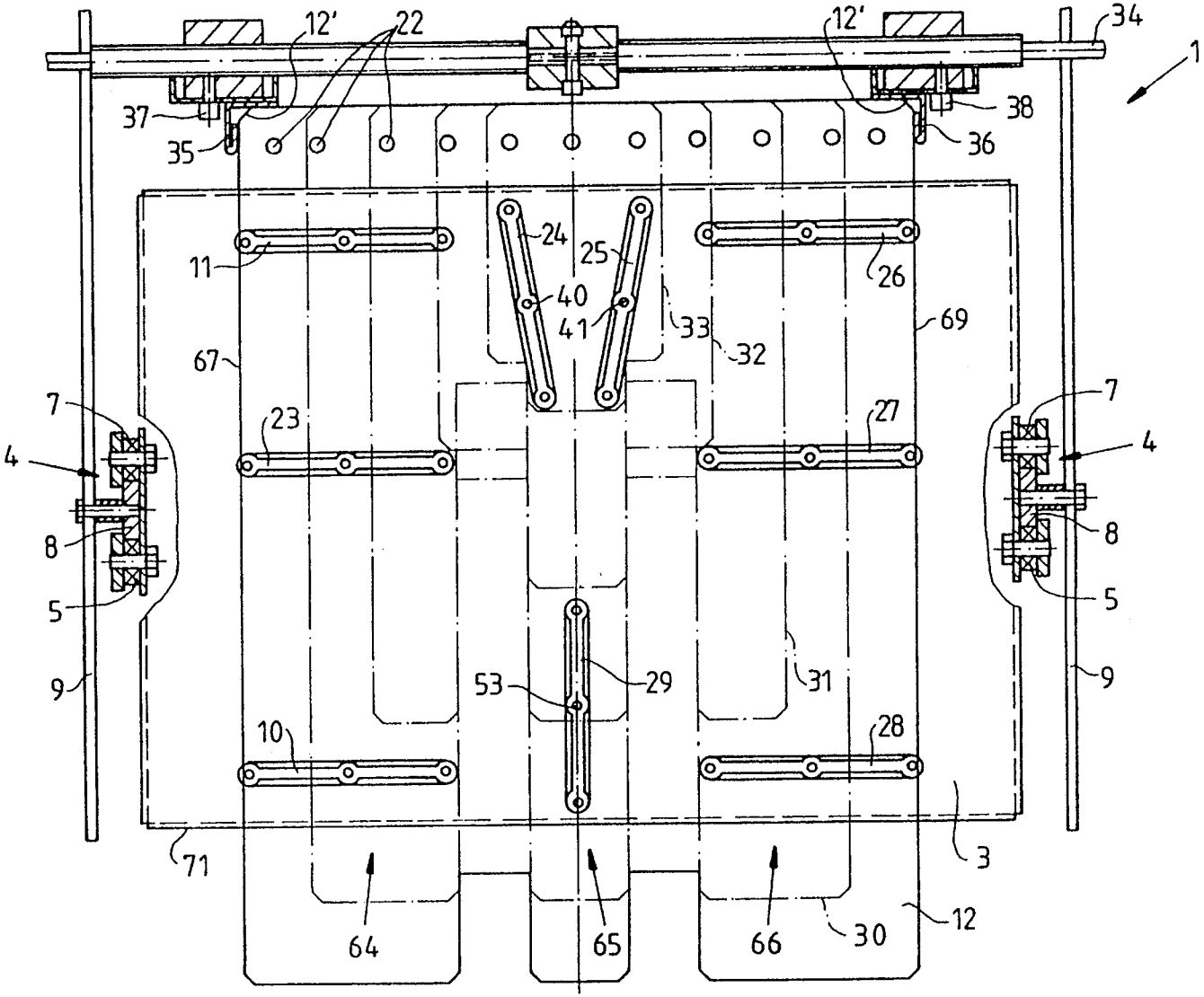
FIG. 4 is a top plan view of the pile table with spacers arranged thereon.

The plan view in FIG. 4 of the device 1 for receiving sheet piles thereon shows the pile table 3 with the spacers 10, 11 and 23 to 29 secured thereon. Also shown in FIG. 4, represented partly by solid lines and partly by dot-dash lines, i.e., in phantom, are pile supports 12 and 30 to 33, which have varied dimensions corresponding to the particular size or format of the paper sheets to be supported thereon. The various pile supports 12, and 30 to 33 are illustrated in the same figure of the drawing solely for information purposes; in operation, naturally, only one pile support of suitable size will be disposed on the spacers.

It is apparent that the spacers 10, 11 and 23 to 29 have an elongated and especially rodlike shape and lie with the elongated undersides thereof on the pile table 3. Advantageously, these spacers 10, 11 and 23 to 29 may be formed of plastic material.

The spacers 10, 11 and 23 to 29 are disposed in three groups 64, 65 and 66 on the pile table 3; the spacers 10, 11 and 23 of the first group 64 and the spacers 26, 27 and 28 of the third group 66 are disposed both parallel to one another and parallel to the front or leading edge 71 of the pile table 3. The spacers 24, 25 and 19 of the middle or second group 65 are disposed transversely to the other spacers 10, 11, 23, 26, 27 and 28. The respective pairs of spacers 11 and 26, 23 and 27, and 10 and 28, are mutually aligned. In the interest of providing non-tilting support especially of the pile supports 32 and 33 having relatively smaller sizes or formats, the two adjacent spacers 24 and 25 are extended lengthwise obliquely to one another and, moreover, extend obliquely to the lengthwise direction of the other spacers.

It is readily apparent that the device 1 for receiving sheet piles thereon has the side walls 9 on both sides thereof to which, as mentioned hereinbefore, the rails 8 which serve to guide the guide carriages 4 are bolted or screwed.

The respective side walls 9 support a shaft 34 at both ends thereof, whereon two pile guides 35 and 36 are secured which, in cross section, have the shape of a right angle, and support respective corners 12' of the pile support 12 which extend in the direction of the shaft 34. The pile guides 35 and 36 can be adjusted via a spindle, so that they are adjustable to the proper size or format of the sheets.

Figure 5:
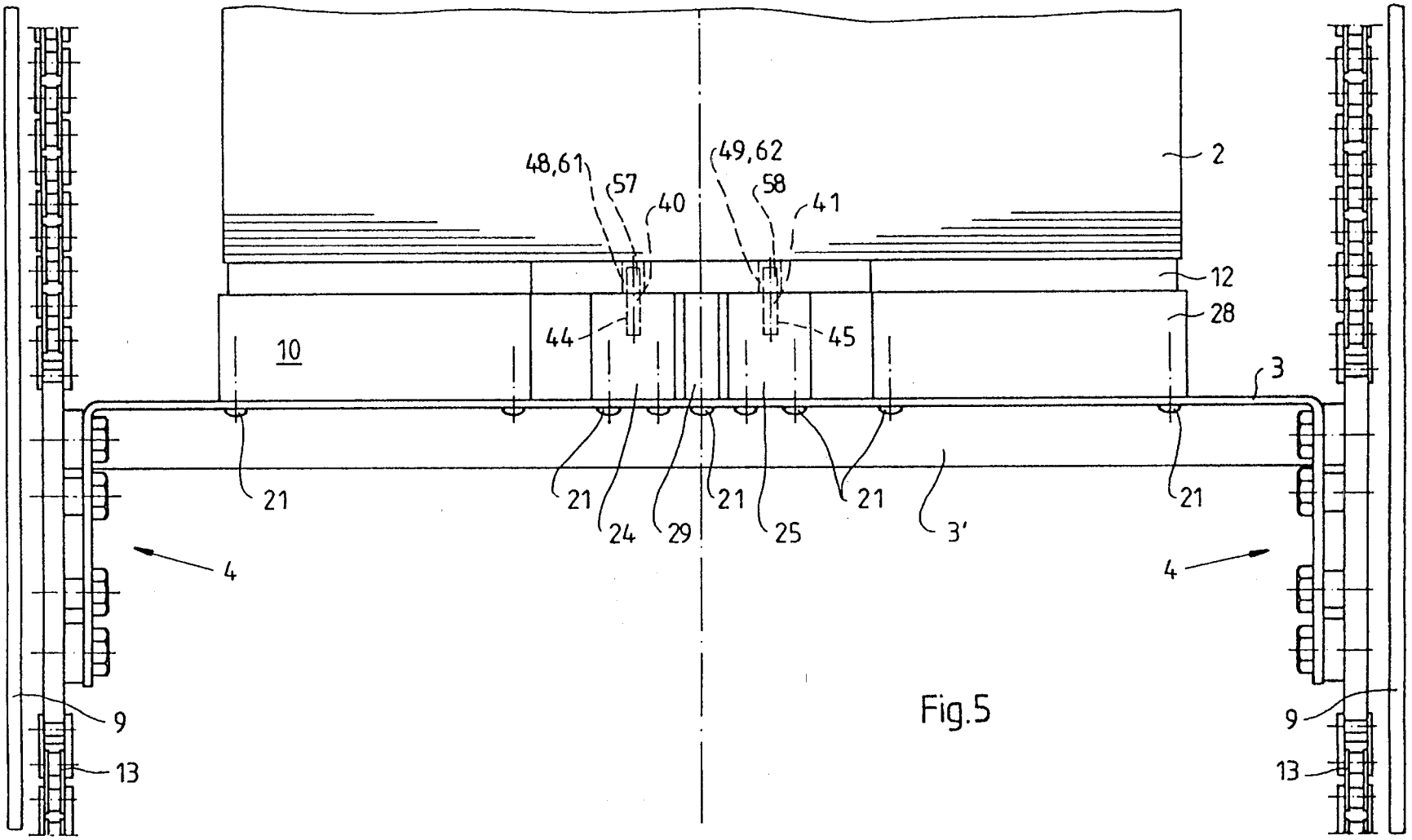
FIG. 5 is an enlarged fragmentary front elevational view of FIG. 1, as seen in the direction of the arrow V, and showing the pile table with a pile support disposed thereon.

FIG. 5 is a front elevational view of the pile table 3 having the shape of an inverted U. Two legs of the U and a tabletop 3' located between these legs are readily apparent. The guide carriages 4 are bolted or screwed to the respective two legs of the U. The tabletop 3' is formed with bores, and screws or bolts 21 with which the spacers are secured to the pile table 3' extend through these bores. In the viewing direction of FIG. 5, the spacers 10, 24, 29, 25 and 28 can be seen. Resting on these spacers is the pile support 12, on which, in turn, the sheet pile 2 is disposed. The spacers 10, 24, 29, 25 and 28 (and also the other spacers not visible in FIG. 5) are respectively secured at the end regions thereof to the pile table 3 by means of the aforementioned screws or bolts 21. At the top of the spacers 10, 24, 29, 25 and 29, as viewed in FIG. 5, recesses 44 and 45 are provided in the respective spacers, the recesses 44 and 45 being formed as blind bores into which pins 40 and 41 are inserted in such a manner that they project beyond the top of the respective spacers. If a pile support 12 is associated with the spacers, then the pins 40 and 41 which form the respective protrusions or projections 57 and 58 enter into the corresponding bores 48 and 49 of the pile support 12. The pile support 12 is thus positioned immovably and precisely, in a relatively simple manner.

FIG. 4 very clearly illustrates the basic principle of the invention, that relatively smaller pile supports rest only on some of the spacers, and that pile supports of relatively larger size or format are supported on a correspondingly greater number of spacers.

We claim:

1. In a sheet-fed printing press, a device for receiving sheet piles thereon, comprising a pile table movable up and down, spacers disposed on said pile table, and pile supports of respective sizes corresponding to respective sizes or formats of the sheets disposable on said pile supports, said spacers being distributed over and permanently fixed to said pile table so that the respective pile supports of varying sizes rests on a selected number of spacers sufficient for safely supporting the respective pile supports against tilting, the pile supports of relatively smaller size resting on a smaller number of the respective spacers than the pile supports of relatively larger size, and all of said spacers remaining fixed to said pile table regardless of the size of the respective pile support resting on said spacers.

2. Device according to claim 1, wherein said spacers have a rodlike shape and rest with a respective elongated side thereof on said pile table.

3. Device according to claim 2, wherein said spacers have protrusions on the respective elongated sides thereof facing away from said pile table, said protrusions engaging in corresponding receiving depressions formed in said pile supports upon placement of said pile supports on said spacers.

4. Device according to claim 3, wherein said protrusions are of rodlike construction.

5. Device according to claim 4, wherein said protrusions are formed as separate pins, which are secured in respective recesses formed in said spacers.

6. Device according to claim 5, wherein said pins have a circular cross section.

7. Device according to claim 3, wherein said receiving depressions are formed as bores.

8. Device according to claim 1, wherein said spacers are formed of plastic material.

9. Device according to claim 1, wherein said spacers are elongated spacers, at least one of said spacers extends transversely to at least another of said spacers.

* * * * *